US009408002B2

(12) United States Patent
Ypma et al.

(10) Patent No.: US 9,408,002 B2
(45) Date of Patent: Aug. 2, 2016

(54) LEARNING CONTROL OF HEARING AID PARAMETER SETTINGS

(71) Applicant: GN ReSound A/S, Ballerup (DK)

(72) Inventors: Alexander Ypma, Veldhoven (NL); Almer Jacob Van Den Berg, Eindhoven (NL); Aalbert De Vries, Eindhoven (NL)

(73) Assignee: GN ReSound A/S, Ballerup (DK)

( * ) Notice: Subject to any disclaimer, the term of this patent is extended or adjusted under 35 U.S.C. 154(b) by 0 days.

(21) Appl. No.: 13/852,914

(22) Filed: Mar. 28, 2013

(65) Prior Publication Data

US 2014/0146986 A1 May 29, 2014

Related U.S. Application Data

(63) Continuation of application No. 12/294,377, filed as application No. PCT/DK2007/000133 on Mar. 17, 2007.

(60) Provisional application No. 60/785,581, filed on Mar. 24, 2006.

(30) Foreign Application Priority Data

Mar. 24, 2006 (DK) ..... 2006 00424

(51) Int. Cl.
*H04R 25/00* (2006.01)

(52) U.S. Cl.
CPC ..... *H04R 25/505* (2013.01); *H04R 25/70* (2013.01); *H04R 2225/41* (2013.01)

(58) Field of Classification Search
CPC .. H04R 25/70; H04R 25/505; H04R 2225/39; H04R 2225/41; H04R 2225/61
USPC ..... 381/312–331
See application file for complete search history.

(56) References Cited

U.S. PATENT DOCUMENTS 7,869,606 B2 * 1/2011 Fichtl ..... H04R 25/70 381/314
2003/0091197 A1 * 5/2003 Roeck ..... H04R 25/407 381/60

(Continued)

FOREIGN PATENT DOCUMENTS

EP 1453357 9/2004
EP 1523219 4/2005

(Continued)

OTHER PUBLICATIONS

W.D. Penny; "Signal Processing Course" Chapter 11, Kalman Filters; Apr. 2000; pp. 127-140.

(Continued)

*Primary Examiner* — Matthew Eason
(74) *Attorney, Agent, or Firm* — Vista IP Law Group, LLP

(57) ABSTRACT

In a hearing aid with a signal processor for signal processing in accordance with selected values of a set of parameters Θ, a method of automatic adjustment of a set z of the signal processing parameters Θ, using a set of learning parameters θ of the signal processing parameters Θ is provided, wherein the method includes extracting signal features u of a signal in the hearing aid, recording a measure r of an adjustment e made by the user of the hearing aid, modifying z by the equation $z=u\theta+r$, and absorbing the user adjustment e in θ by the equation $\theta_N=\Phi(u,r)+\theta_P$, wherein $\theta_N$ is the new values of the learning parameter set θ, $\theta_P$ is the previous values of the learning parameter set θ, and Φ is a function of the signal features u and the recorded adjustment measure r.

27 Claims, 9 Drawing Sheets

(56) References Cited

U.S. PATENT DOCUMENTS

Figure 1:
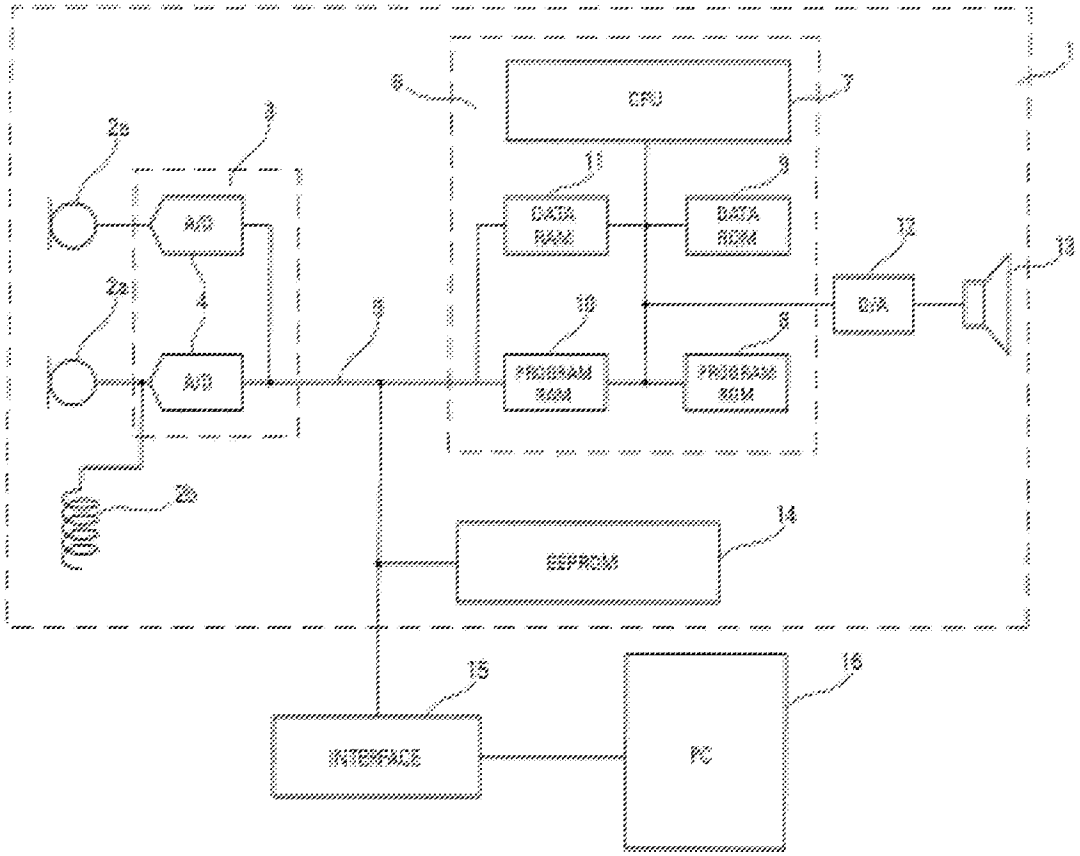

| | | | | |
|---|---|---|---|---|
| 2004/0190738 | A1* | 9/2004 | Meier | H04R 25/505 381/312 |
| 2004/0190739 | A1* | 9/2004 | Bachler | H04R 25/305 381/314 |
| 2004/0208331 | A1* | 10/2004 | Chalupper | H04R 25/70 381/314 |
| 2005/0036637 | A1 | 2/2005 | Janssen | |
| 2005/0129262 | A1* | 6/2005 | Dillon | A61N 1/36032 381/312 |
| 2006/0222194 | A1* | 10/2006 | Bramslow | H04R 25/305 381/314 |
| 2007/0076909 | A1* | 4/2007 | Roeck | H04R 25/70 381/312 |
| 2010/0040247 | A1* | 2/2010 | Ypma | H04R 25/505 381/314 |
| 2010/0202637 | A1* | 8/2010 | Cornelisse | H04R 25/70 381/314 |

FOREIGN PATENT DOCUMENTS

| | | |
|---|---|---|
| WO | 0154456 | 7/2001 |
| WO | 2004056154 | 7/2004 |

OTHER PUBLICATIONS

International Search Report for corresponding application PCT/DK2007/000133, 12 pgs., dated Jul. 8, 2007.
English translation of abstract for EP Patent Application No. 1523219, publication date Apr. 13, 2005.
English translation of abstract for EP Patent Application No. 1453357, publication date Sep. 1, 2004.
Non-final Office Action dated Sep. 23, 2011 for U.S. Appl. No. 12/294,377.
Final Office Action dated Mar. 28, 2012 for U.S. Appl. No. 12/294,377.
Advisory Action dated Sep. 17, 2012 for U.S. Appl. No. 12/294,377.
Notice of Allowance and Fee(s) Due dated Dec. 1, 2015, for related U.S. Appl. No. 12/294,377.

* cited by examiner

Multiple mode user, thresholded adjustment. No learning. See Fig. 4 for details on the subfigures.

LEARNING CONTROL OF HEARING AID PARAMETER SETTINGS

RELATED APPLICATION DATA

This application is a continuation of U.S. patent application Ser. No. 12/294,377, filed on Sep. 21, 2009, pending, which is the national stage of International Application No. PCT/DK2007/000133, filed on Mar. 17, 2007, lapsed, which claims priority to and the benefit of Danish Patent Application PA 2006 00424, filed on Mar. 24, 2006, and U.S. Provisional Patent Application No. 60/785,581, filed on Mar. 24, 2006, lapsed. The disclosures of all of the above applications are expressly incorporated by reference in their entireties herein.

FIELD

The present application relates to a new method for automatic adjustment of signal processing parameters in a hearing aid. It is based on an interactive estimation process that incorporates—possibly inconsistent—user feedback.

BACKGROUND AND SUMMARY

In a potential annual market of 30 million hearing aids, only 5.5 million instruments are sold. Moreover, one out of five buyers does not wear the hearing aid(s). Apparently, despite rapid advancements in Digital Signal Processor (DSP) technology, user satisfaction rates remain poor for modern industrial hearing aids.

Over the past decade, hearing aid manufacturers have focused on incorporating very advanced DSP technology and algorithms in their hearing aids. As a result, current DSP algorithms for industrial hearing aids feature a few hundred tuning parameters. In order to reduce the complexity of fitting the hearing aid to a specific user, manufacturers leave only a few tuning parameters adjustable and fix the rest to 'reasonable' values. Oftentimes, this results in a very sophisticated DSP algorithm that does not satisfactorily match the specific hearing loss characteristics and perceptual preferences of the user.

It is an object to provide a method for automatic adjustment of signal processing parameters in a hearing aid that is capable of incorporating user perception of sound reproduction, such as sound quality over time.

According to some embodiments, the above-mentioned and other objects are fulfilled in a hearing aid with a signal processor for signal processing in accordance with selected values of a set of parameters $\underline{\Theta}$, by a method of automatic adjustment of a set $\underline{z}$ of the signal processing parameters $\underline{\Theta}$, using a set of learning parameters $\underline{\theta}$ of the signal processing parameters $\underline{\Theta}$, the method comprising the steps of:

extracting signal features $\underline{u}$ of a signal in the hearing aid, recording a measure $\underline{r}$ of an adjustment $\underline{e}$ made by the user of the hearing aid, modifying $\underline{z}$ by the equation:

$$\underline{z}=\underline{u}\theta+\underline{r}$$

and absorbing the user adjustment $\underline{e}$ in $\underline{\theta}$ by the equation:

$$\theta_N=\Phi(\underline{u},\underline{r})+\theta_P$$

wherein $\underline{\theta}_N$ is the new values of the learning parameter set $\underline{\theta}$, $\underline{\theta}_P$ is the previous values of the learning parameter set $\underline{\theta}$, and $\Phi$ is a function of the signal features $\underline{u}$ and the recorded adjustment measure $\underline{r}$.

$\Phi$ may be computed by a normalized Least Means Squares algorithm, a recursive Least Means Squares algorithm, a Kalman algorithm, a Kalman smoothing algorithm, or any other algorithm suitable for absorbing user preferences.

In accordance with some embodiments, in a hearing aid with a signal processor for signal processing in accordance with selected values of a set of parameters $\underline{\Theta}$, a method of automatic adjustment of a set $\underline{z}$ of the signal processing parameters $\underline{\Theta}$, using a set of learning parameters $\underline{\theta}$ of the signal processing parameters $\underline{\Theta}$ is provided, wherein the method includes extracting signal features $\underline{u}$ of a signal in the hearing aid, recording a measure $\underline{r}$ of an adjustment $\underline{e}$ made by the user of the hearing aid, modifying $\underline{z}$ by the equation $\underline{z}=\underline{u}\,\underline{\theta}+\underline{r}$, and absorbing the user adjustment $\underline{e}$ in $\underline{\theta}$ by the equation $\theta_N=\Phi(\underline{u},\underline{r})+\theta_P$, wherein $\underline{\theta}_N$ is the new values of the learning parameter set $\underline{\theta}$, $\underline{\theta}_P$ is the previous values of the learning parameter set $\underline{\theta}$, and $\Phi$ is a function of the signal features $\underline{u}$ and the recorded adjustment measure $\underline{r}$.

In one embodiment, the signal features constitutes a matrix $\underline{U}$, such as a vector $\underline{u}$.

It should be noted that the equation $\underline{z}=\underline{u}\,\underline{\theta}+\underline{r}$, underlining indicates a set of variables, such as a multi-dimensional variable, for example a two-dimensional or a one-dimensional variable. The equation constitutes a model, preferably a linear model, mapping acoustic features and user correction onto signal processing parameters.

In some embodiments, $\underline{z}$ is a one-dimensional variable, the signal features constitute a vector $\underline{u}$ and the measure $\underline{r}$ of a user adjustment $\underline{e}$ is absorbed in $\underline{\theta}$ by the equation:

$$\underline{\theta}_N = \frac{\mu}{\sigma^2 + \underline{u}^T\underline{u}}\underline{u}^T\underline{r} + \underline{\theta}_P$$

wherein $\mu$ is the step size, and subsequently a new recorded measure $\underline{r}_N$ of the user adjustment $\underline{e}$ is calculated by the equation:

$$\underline{r}_N=\underline{r}_P-\underline{u}^T\underline{\theta}_P+\underline{e}$$

wherein $\underline{r}_P$ is the previous recorded measure. Further, a new value $\sigma_N$ of the user inconsistency estimator $\sigma^2$ is calculated by the equation:

$$\sigma_N^2=\sigma_P^2+\gamma\lfloor r_N^2-\sigma_P^2\rfloor$$

wherein $\sigma_P$ is the previous value of the user inconsistency estimator, and $\gamma$ is a constant.

$\underline{z}$ may be a variable g and $\underline{r}$ may be a variable r, so that $$g=\underline{u}^T\underline{\theta}+r.$$

Advantageously, the method in a hearing aid according to the present embodiments has a capability of absorbing user preferences changing aver time and/or changes in typical sound environments experienced by the user. The personalization of the hearing aid is performed during normal use of the hearing aid. These advantages are obtained by absorbing user adjustments of the hearing aid in the parameters of the hearing aid processing. Over time, this approach leads to fewer user manipulations during periods of unchanging user preferences. Further, the method in the hearing aid is robust to inconsistent user behaviour.

According to some embodiments, user preferences for algorithm parameters are elicited during normal use in a way that is consistent and coherent and in accordance with theory for reasoning under uncertainty.

According to some embodiments, the hearing aid is capable of learning a complex relationship between desired adjustments of signal processing parameters and corrective user adjustments that are a personal, time-varying, nonlinear, and/or stochastic.

A hearing aid algorithm F(.) is a recipe for processing an input signal x(t) into an output signal $y(t)=F(x(t):\theta)$, where $\theta \in \Theta$ is a vector of tuning parameters such as compression ratio's, attack and release times, filter cut-off frequencies, noise reduction gains etc. The set of all interesting values for $\theta$ constitutes the parameter space $\Theta$ and the set of all 'reachable' algorithms constitutes an algorithm library $F(\Theta)$. After a hearing aid algorithm library $F(\Theta)$ has been developed, the next challenging step is to find a parameter vector value $\theta^* \in \Theta$ that maximizes user satisfaction.

The method may for example be employed in automatic control of the volume setting, maximal noise reduction, settings relating to the sound environment, etc.

Fitting is the final stage of parameter estimation, usually carried out in a hearing clinic or dispenser's office, where the hearing aid parameters are adjusted to match a specific user. Typically, according to the prior art the audiologist measures the user profile (e.g. audiogram), performs a few listening tests with the user and adjusts some of the tuning parameters (e.g. compression ratio's) accordingly. However, according to some embodiments, the hearing aid is subsequently subjected to an incremental adjustment of signal processor parameters during its normal use that lowers the requirement for manual adjustments.

After a user has left the dispenser's office, the user may fine-tune the hearing aid using a volume-control wheel or a push-button on the hearing aid with a model that learns from user feedback inside the hearing aid. The personalization process continues during normal use. The traditional volume control wheel may be linked to a new adaptive parameter that is a projection of a relevant parameter space. For example, this new parameter, in the following denoted the personalization parameter, could control (1) simple volume, (2) the number of active microphones or (3) a complex trade-off between noise reduction and signal distortion. By turning the 'personalization wheel' to preferred settings and absorbing these preferences in the model resident in the hearing aid, it is possible to keep learning and fine-tuning while a user wears the hearing aid device in the field.

The output of an environment classifier may be included in the user adjustments for provision of a method that is capable of distinguishing different user preferences caused by different sound environments. Hereby, signal processing parameters may automatically be adjusted in accordance with the user's perception of the best possible parameter setting for the actual sound environment.

Thus, in one embodiment, the method further comprises the step of classifying the signal features $\underline{u}$ into a set of predetermined signal classes with respective classification signal features $\underline{u}^*$, and substitute signal features $\underline{u}$ with the classification signal features $\underline{u}^*$ of the respective class.

DESCRIPTION OF THE DRAWING FIGURES

Figure 2:
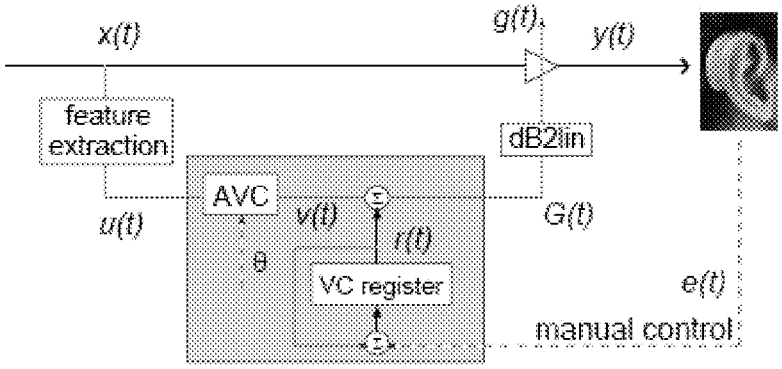
Figure 3:
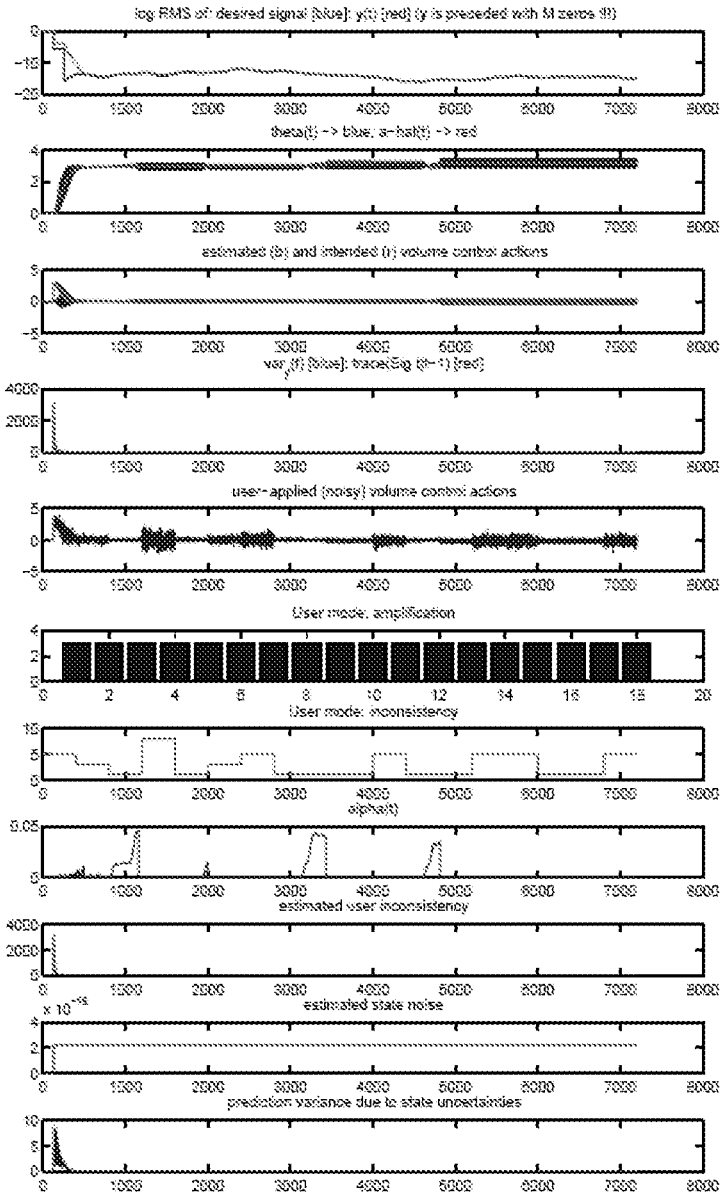
Figure 4:
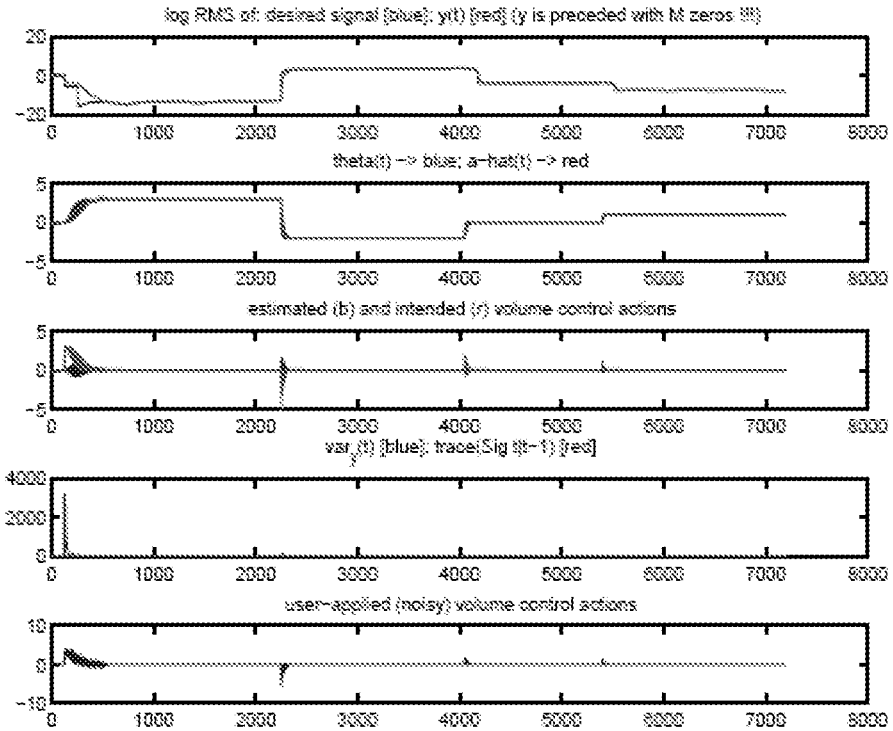
Figure 5:
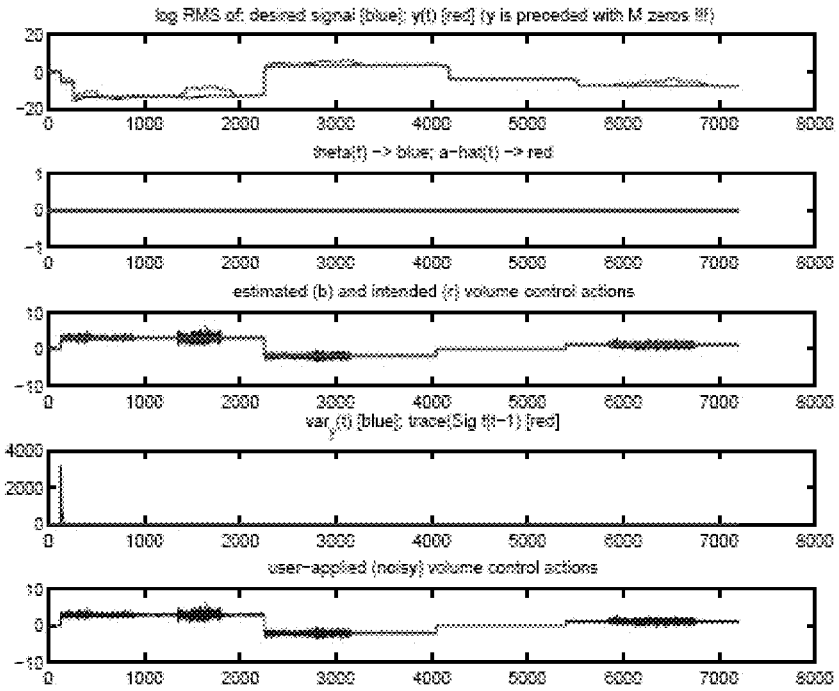
Figure 6:
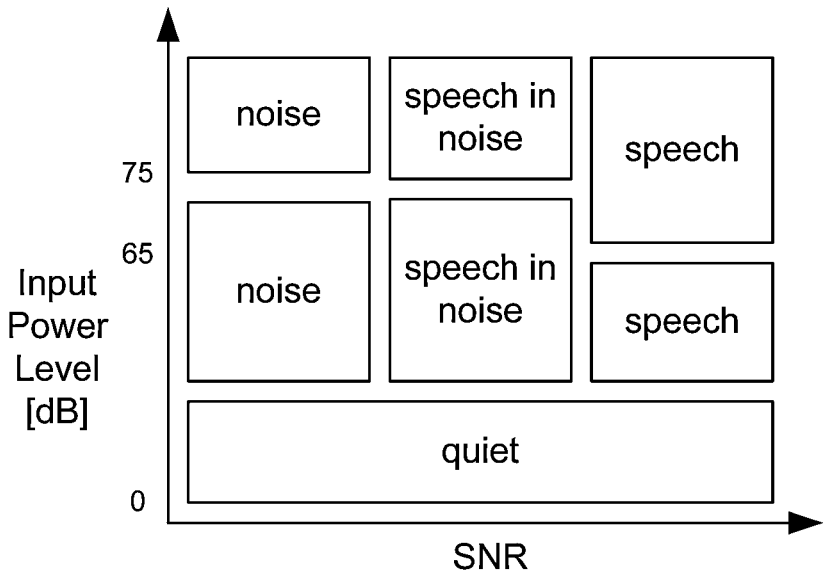
Figure 7:
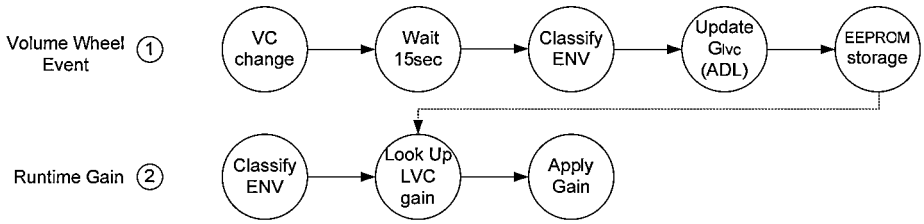
Figure 8:
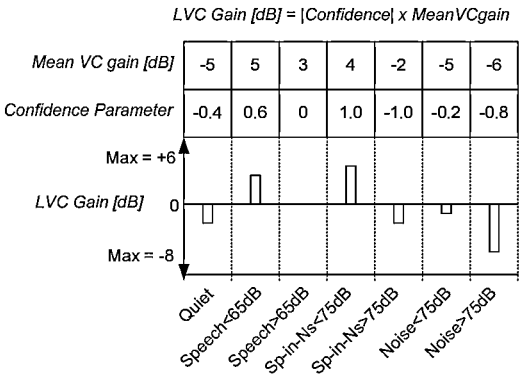
Figure 9:
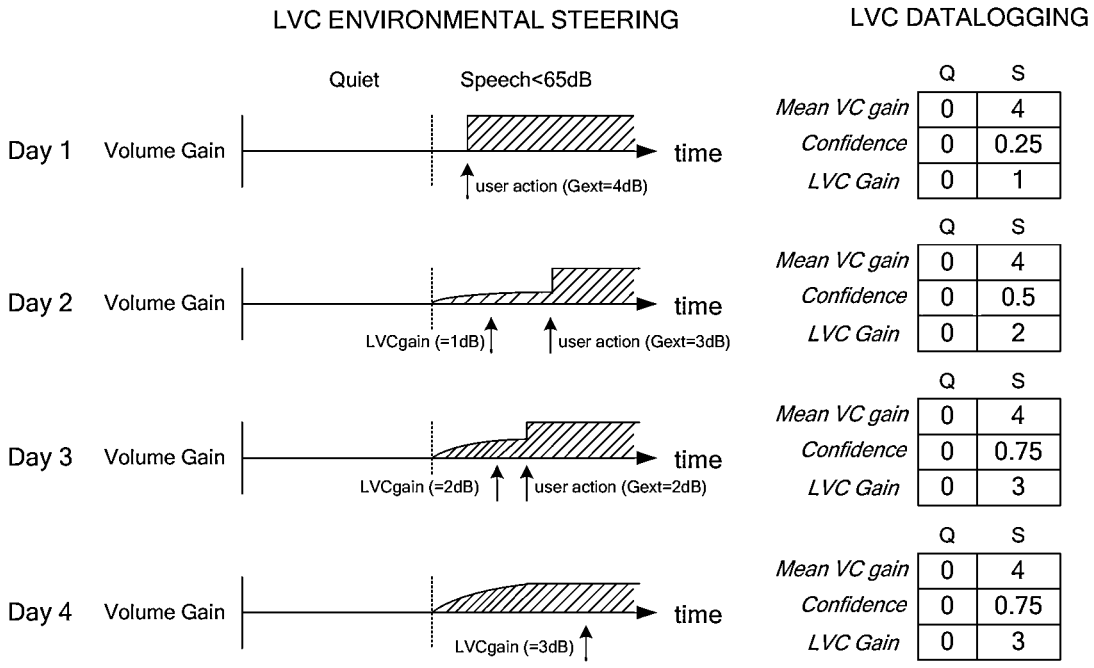
Figure 10:
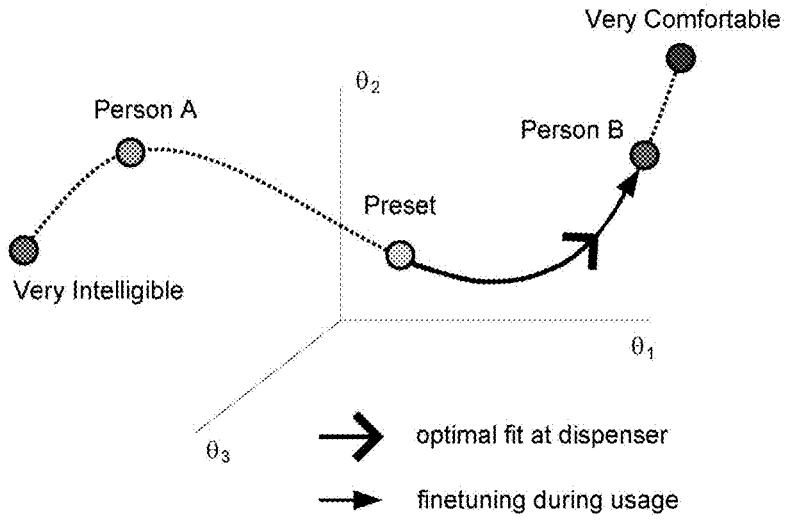

The above and other features and advantages will become more apparent to those of ordinary skill in the art by describing in detail exemplary embodiments thereof with reference to the attached drawings in which:

FIG. 1 shows a simplified block diagram of a digital hearing aid according to some embodiments, FIG. 2 is a flow diagram of a learning control unit according to some embodiments, FIG. 3 is a plot of variables as a function of user adjustment for a user with a single preference, FIG. 4 is a plot of variables as a function of user adjustment for a user with various preferences, FIG. 5 is a plot of variables as a function of user adjustment for a user with various preferences without learning, FIG. 6 illustrates an environment classifier with seven environmental states, FIG. 7 illustrates an LVC algorithm flow diagram, FIG. 8 illustrates an example of stored LVC data, FIG. 9 illustrates an example of adjustments according to an LVC algorithm according to some embodiments, and FIG. 10 is a plot of an adjustment path of a combination of parameters.

DETAILED DESCRIPTION

The embodiments will now be described more fully hereinafter with reference to the accompanying drawings, in which exemplary embodiments are shown. The invention may, however, be embodied in different forms and should not be construed as limited to the embodiments set forth herein. Rather, these embodiments are provided so that this disclosure will be thorough and complete, and will fully convey the scope of the application to those skilled in the art. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 shows a simplified block diagram of a digital hearing aid according some embodiments. The hearing aid 1 comprises one or more sound receivers 2, e.g. two microphones 2*a* and a telecoil 2*b*. The analogue signals for the microphones are coupled to an analogue-digital converter circuit 3, which contains an analogue-digital converter 4 for each of the microphones.

The digital signal outputs from the analogue-digital converters 4 are coupled to a common data line 5, which leads the signals to a digital signal processor (DSP) 6. The DSP is programmed to perform the necessary signal processing operations of digital signals to compensate hearing loss in accordance with the needs of the user. The DSP is further programmed for automatic adjustment of signal processing parameters in accordance with some embodiments.

The output signal is then fed to a digital-analogue converter 12, from which analogue output signals are fed to a sound transducer 13, such as a miniature loudspeaker.

In addition, externally in relation to the DSP 6, the hearing aid contains a storage unit 14, which in the example shown is an EEPROM (electronically erasable programmable read-only memory). This external memory 14, which is connected to a common serial data bus 17, can be provided via an interface 15 with programmes, data, parameters etc. entered from a PC 16, for example, when a new hearing aid is allotted to a specific user, where the hearing aid is adjusted for precisely this user, or when a user has his hearing aid updated and/or re-adjusted to the user's actual hearing loss, e.g. by an audiologist.

The DSP 6 contains a central processor (CPU) 7 and a number of internal storage units 8-11, these storage units containing data and programmes, which are presently being executed in the DSP circuit 6. The DSP 6 contains a programme-ROM (read-only memory) 8, a data-ROM 9, a programme-RAM (random access memory) 10 and a data-RAM 11. The two first-mentioned contain programmes and data which constitute permanent elements in the circuit, while the two last-mentioned contain programmes and data which can be changed or overwritten.

Typically, the external EEPROM 14 is considerably larger, e.g. 4-8 times larger, than the internal RAM, which means that certain data and programmes can be stored in the EEPROM so that they can be read into the internal RAMs for execution as required. Later, these special data and programmes may be overwritten by the normal operational data and working programmes. The external EEPROM can thus contain a series of programmes, which are used only in special cases, such as e.g. start-up programmes.

FIG. 2 schematically illustrates the operation of a learning volume control algorithm according to some embodiments. The illustrated hearing aid circuit includes an automatic volume control circuit that operates to adjust the amplitude of a signal x(t) by a gain g(t) to output y(t)=g(t)x(t). An automatic volume control (AVC) module controls the gain $g_t$. The AVC unit takes as input $u_t$, which holds a vector of relevant features with respect to the desired gain for signal $x_t$. For instance, $u_t$ could hold short-term RMS and SNR estimates of $x_t$. In a linear AVC, the desired (log-domain) gain $G_t$ is a linear function (with saturation) of the input features, i.e.

$$G_t=u_t^T\theta_t+r_t \tag{1}$$

where the offset $r_t$ is read from a volume-control (VC) register, $r_t$ is a measure of the user adjustment. Sometimes, during operation of the device, the user is not satisfied with the volume of the received signal $y_t$. He is provided with the opportunity to manipulate the gain of the received signal by changing the contents of the VC register through turning a volume control wheel. $e_t$ represents the accumulated change in the VC register from t−1 to t as a result of user manipulation. The learning goal is to slowly absorb the regular patterns in the VC register into the AVC model parameters θ. Ultimately, the process will lead to a reduced number of user manipulations. An additive learning process is utilized, $$\theta_t = \theta_{t+1} + \overset{0}{\theta}_t \tag{2}$$

where the amount of parameter drift $$\overset{0}{\theta}_t$$

is determined by the selected learning algorithms, such as LMS or Kalman filtering.

A parameter update is performed only when knowledge about the user's preferences is available. While the VC wheel is not being manipulated during normal operation of the device, the user may be content with the delivered volume, but this is uncertain. After all, the user may not be wearing the device. However, when the user starts turning the VC wheel, it is assumed that he is not content at that moment. The beginning of a VC manipulation phase is denoted the dissent moment. While the user manipulates the VC wheel, he is likely still searching for a better gain. A next learning moment occurs right after the user has stopped changing the VC wheel position. At this time, it is assumed that he has found a satisfying gain; well call this the consent moment. Dissent and consent moments identify situations for collecting negative and positive teaching data, respectively. Assume that the kth consent moment is detected at $t=t_k$. Since the updates only take place at times $t_k$, it is useful to define a new time series as $$\overset{0}{\theta}_k = \sum_t \overset{0}{\theta}_t \delta(t - t_k)$$

and similar definitions for converting $r_t$ to $r_k$ etc. The new sequence, indexed by k rather than t, only selects samples at consent moments from the original time series. Note that by considering only instances of explicit consent, there is no need for an internal clock in the system. In order to complete the algorithm, the drift $$\overset{0}{\theta}_t$$

needs to be specified.

Two update algorithms according to the present embodiments are further described below.

Learning by the nLMS Algorithm:

In the nLMS algorithm, the learning update Eq. (2) should not affect the actual gain $G_t$ leading to compensation by subtracting an amount $u_t^T\theta_t$ from the VC register. The VC register contents are thus described by $$r_{t+1}=r_t-u_t^T\theta_t+e_{t+1} \tag{3}$$

wherein t is a time of consent and t+1 is the next time of consent and that only at a time of consent, user adjustment $e_t$ and discount $u^T\overset{0}{\theta}$ are applied. Apart from specifying the parameter drift $\tilde{\lambda}_t$, Eqs. (1), (2), and (3) describe the evolution of the Learning Volume Control (LVC) algorithm. It is assumed that $$u^T\theta=[1,u_1,\ldots,u_m][\theta_0,\theta_1,\ldots,\theta_m]^T$$

in other words, $\theta_0$ is provided to absorb the preferred mean VC offset. It is then reasonable to assume a cost criterion $\epsilon[r_k^2]$, to be minimized with respect to θ. A normalized LMS-based learning volume control is effectively implemented using the following update equation $$\overset{0}{\theta}_k = \frac{\mu}{\sigma_{k2} + u_k^T u_k} u_k^T r_k \tag{4}$$

where μ is a learning rate and $\sigma_k^2$ is an estimate of $\epsilon[r_k^2]$. In practice, it is helpful to select a separate learning rate for adaption of the offset parameter $\theta_0$. $\epsilon[r_k^2]$ is tracked by a leaky integrator, $$\sigma_k^2=\sigma_{k-1}^2+\gamma\times[r_k^2-\sigma_{k-1}^2] \tag{5}$$

where γ sets the effective window of the integrator. Note that the LMS-based updating implicitly assumes that 'adjustment errors' are Gaussian distributed. The variable $\sigma_k^2$ essentially tracks the user inconsistency. As a consequence, for enduring large values of $r_k^2$, the parameter drift will be small, which means that the user's preferences are not absorbed. This is a desired feature of the LVC system. It is possible to replace $\sigma_k^2$ in Eq. (4) by alternative measures of user inconsistency. Alternatively, in the next section the Kalman filter is introduced, which is also capable of absorbing inconsistent user responses.

Learning with a Kalman Filter:

In this model, the user is assumed to be a 'linear user' who experiences a certain threshold $\bar{\lambda}$ on the deviation from his preferred amplification level (vector) a before he responds. Furthermore, a feature vector $u_t$ is to be extracted, and the user prefers the processed sound: $G_t^{desired}=au_t$. The 'internal preference vector' a is supposed to generalise to different auditory scenes. This requires that feature vector $u_t$ contains relevant features that describe the acoustic input well.

The user will express his preference for this sound level by adjusting the volume wheel, i.e. by feeding back a correction factor that is ideally noiseless ($\tilde{e}_k$) and adding it to the register $r_k$. In reality, the actual user correction $e_k$ will be noisy, $r_k=r_{k-1}+e_k=r_{k-1}+\tilde{e}_k+v_k$, where $v_k$ is a noise term. In other words, the current register value at the current consent moment equals the register value at the previous explicit consent moment plus the accumulated corrections for the current explicit consent moment. The accumulated noise $v_k$ is supposed to be Gaussian noise. The user is assumed to experiences an 'annoyance threshold' $\tilde{e}$ such that $|\tilde{e}_i|\leq\tilde{e}\rightarrow e_i=0$.

When a user changes his preferences, he will probably induce noisy corrections to the volume wheel. In the nLMS algorithm, these increased corrections would contribute to the estimated variance $\sigma_k^2$, hence lead to a decrease in the estimated learning rate.

However, the apparent noise in the correction could also be caused by changed preferences. It is desirable to increase the learning rate with the estimated state noise variance in order to respond quickly to a changed preference pattern. Allowing the parameter vector that is to be estimated to 'drift' with some (state) noise, leads to the following state space formulation of the LVC problem:

$$\theta_{k+1}=\theta_k+\upsilon_k,\upsilon_k\square N(0,\delta^2 I)$$

$$G_k=u_k^T\theta_k+r_k,r_k\square \text{ nongaussian}$$

In W. D. Penny, "Signal processing course", Tech. Rep., University College London, 2000, a comparison is made between nLMS and Kalman filter based updating. Both algorithms give rise to an effective update rule $$\hat{\theta}_k=\hat{\theta}_{k-1}+\overset{0}{\theta}=\hat{\theta}_{k-1}+\mu_k u_k^T r_k \tag{6}$$

for the mean $\hat{\theta}_k$ of the parameter vector and additionally, the Kalman filter also updates its variance $\Sigma_k$. The difference between the algorithms is in the $\mu_k$ term. In the Kalman LVC it is:

$$\mu_k=\Sigma_{k|k-1}(u_k\Sigma_{k|k-1}u_k^T+\sigma_k^2)^{-1} \tag{7}$$

where $\mu_k$ is now a learning rate matrix. For the Kalman algorithm, the learning rate is proportional to the state noise $v_k$, through the predicted covariance of state variable $\theta_k$, $\Sigma_{k|k-1}=\Sigma_{k-1}+\delta^2 I$. The state noise will become high when a transition to a new dynamic regime is experienced. Furthermore, it scales inversely with observation noise $\sigma_{k_2}$, i.e. the uncertainty in the user response. The more consistent the user operates the volume control, the smaller the estimated observation noise, and the larger the learning rate. The nLMS learning rate only scales (inversely) with the user uncertainty. On-line estimates of the noise variances $\delta^2$, $\sigma^2$ are made with the Jazwinski method (cf. W. D. Penny, "Signal processing course", Tech. Rep., University College London, 2000, 2). Further, note that the observation noise is non-gaussian in both nLMS and the state space formulation of the LVC. Especially the latter, which is solved with a recursive (Kalman filter) algorithm, is sensitive to model mismatch. This can be solved by making an explicit distinction between the 'structural part' $\tilde{e}_k$ in the correction and the actual noisy adjustment noise $e_k=\tilde{e}_k+v_k$. Under some extra assumptions on the user this may be written as an extended state space model, for which again the Kalman update equations can be used.

EXPERIMENTS

An evaluation of the Kalman filter LVC was performed to study its behaviour with inconsistent users and users with changing preferences. A music excerpt that was pre-processed to give log-RMS feature vectors was used as input. This was fed to a simulated user who had a preference function $G_t^{desired}=au_t$, and whose noisy corrections were fed back to the LVC as corrections.

Single Mode User—Continuous Adjustment

First, it is assumed that the user has a fixed preferred θ level ("user mode: amplification") of three. It is also assumed that the user adjusts continuously and according to the assumptions above, i.e. he is always in 'explicit dissent' mode, implying $\tilde{e}_k=0$. The user inconsistency changes throughout the simulation (see FIG. 2, the 'User mode: inconsistency subgraph'), where higher values of the inconsistency in a certain time segment denote more 'adjustment noise' in turning the virtual volume control. Also note in FIG. 2 the 'alpha(t)' subgraph, the roughly inverse scaling behaviour of implied learning rate $\alpha_t$ with user inconsistency (which is exactly what is desired).

Multiple Mode User—Thresholded Adjustment

Below, the user has changing amplification level preferences and also experiences a threshold on his annoyance before he will do the adjustment, i.e. $\tilde{e}_k>0$. Note that when adjustments are absent (i.e. when the AVC value comes close to the desired amplification level value a), the noise is also absent (see FIG. 4, bottom 'user-applied (noisy) volume control actions' subgraph). The results indicate a better tracking of user preference and much smaller sensitivity to user inconsistencies when the Kalman-based LVC is used compared to 'no learning'. This can be seen e.g. by comparing the uppermost rows of FIGS. 3 and 4: the LVC 'output' is much more smooth than the 'no learning' output, indicating less sensitivity to user inconsistencies. Please note that in an actual real-time implementation the filtered-out user noise is again added manually in the LVC, in order to ensure full control of the user. Furthermore, FIGS. 3 and 4 show (compare the generated 'user-applied (noisy) volume control actions' subgraphs in both cases) that using the LVC results in fewer adjustments made by the user, which is desired.

nLMS Versus Kalman Filter Implementation:

Both LVC algorithms have been implemented on a real-time platform. Experiments showed that the nLMS algorithm can be made to work nearly as good as the Kalman algorithms. Hyperparameters can be set in order to have the desired robust behaviour. However, adaptation to changing user preferences is slower (due to the absence of state noise, fast switches cannot be made) and generalisation to multidimensional features is troublesome. It is expected that multiple features will be necessary to describe the relevant acoustic scenes adequately. Otherwise, a lot of variability is left unexplained, which can only be remedied with an explicit 'environmental classifier' in place. However, by coding all the relevant contextual information in the feature vector, the LVC could 'steer itself' in different acoustic scenes.

In the LVC example above, the control map was a simple linear map $v(t)=\theta u(t)$, but in general the control map may be non-linear. As an example of the latter, the kernel $v(t)=\Sigma_i\theta_i\times$ $\psi_i(u(t))$, where $\psi_i(.)$ are support vectors, could form an appropriate part of a nonlinear learning machine, v(t) may also be generated by a dynamic model, e.g. v(t) may be the output of a Kalman filter or a hidden Markov model.

Further, the method may be applied for adjustment of noise suppression (PNR) minimal gain, of adaptation rates of feedback loops, of compression attack and release times, etc.

In general, any parameterizable map between (vector) input u and (scalar) output v can be learned through the volume wheel, if the 'explicit consent' moments can be identified. Moreover, sophisticated learning algorithms based on mutual information between inputs and targets are capable to select or discard components from the feature vector u in an online manner.

In another embodiment, a learned volume gain (LVC-gain) process incorporates information on the environment by classification of the environment in seven defined acoustical environments. Furthermore, the LVC-gain is dependent on the learned confidence level. The user can overrule the automated gain adjustment at any time by the volume wheel. Ideally, a consistent user will be less triggered over time to adjust the volume wheel due to the automated volume gain steering. Again, the purpose of the Learning Volume Control (LVC) process is to learn the user preferred volume control setting in a specific acoustical environment.

The environmental classifier (EVC) provides a state of the acoustical environment based on a speech- and noise probability estimator and the broadband input power level. Seven environmental states have been defined as shown in FIG. 6. The EVC output will always indicate one of these states. The assumption is made for the LVC algorithm that the volume control usage is based on the acoustical condition of the hearing impaired user.

The LVC process can be explained briefly using FIG. 7. The LVC process can be split into two parts. In FIG. 7, this is indicated with numbers (1) and (2).

The first process steps indicated by (1) in FIG. 7 include a volume wheel change by the hearing impaired user. When the VC is set to a satisfying position and unaltered e.g. for 15 or 30 seconds, it is assumed that the user is content with the VC setting. At that point in time the state of the EVC is retrieved (because it is assumed that the state of acoustical environment played a role in the user decision for changing the volume wheel). Based on the EVC-state, the volume wheel setting and some history of volume wheel usage, the LVC parameters (Confidence & LVC-gain) are updated and stored in EEPROM. In that sense, the stored LVC parameters represents the 'learned' user profile. An example of stored LVC data is shown in FIG. 8.

The second process steps indicated by (2) in FIG. 7, represent the runtime signal processing routine. When the hearing aid is booted (startup), the learned LVC-Gain is loaded and applied as Volume Gain. The LVC-Gain is steered by the EVC-state and the overall Volume Gain is an addition to the LVC-Gain and the normal Volume Control Gain in accordance with the equation:

$$G_{vol}(t) = G_{ext} + G_{lvc}(\text{evc}, t)$$

Volume wheat ↑ ↑ (learned) gain per environment

The LVC Gain is smoothed over time t so that a sudden EVC state change does not give rise to a sudden LVC-Gain jump (because this could be perceived as annoying by the user).

In FIG. 9, the LVC process is explained by means of an example. In this example, a female user turns on the hearing aid at a certain point during the day. For example, she puts in the hearing aid in the morning in her Quiet room. She walks towards the living room where her husband starts talking about something. Because she needs some volume increase she turns the volume wheel up. The environmental classifier was in state Quiet when she was in her room and the state changed to Speech <65 dB when her husband started talking. It is assumed that this scenario takes place for four successive days. FIG. 9 illustrates that the hearing aid user adjusts the volume wheel only in the first three days; however the amount of desired extra dB's is less each day because the LVC algorithm also provides gain based on the stored LVC data. The LVC-Gain smoothing is represented as a slowly rising gain increase. The confidence parameter (per environment) is updated each time the VC has been changed. In this example, the confidence update operates with a fixed update step, and in this example the update step is set to 0.25.

Further Embodiments

In one exemplary embodiment, the method is utilized to adjust parameters of a comfort control algorithm in which a combination of parameters may be adjusted by the user, e.g. using a single push button, volume wheel or slider. In this way, a plurality of parameters may be adjusted over time incorporating user feedback. The user adjustment is utilized to interpolate between two extreme settings of (an) algorithm(s), e.g. one setting that is very comfortable (but unintelligible), and one that is very intelligible (but uncomfortable). The typical settings of the 'extremes' for a particular patient (i.e. the settings for 'intelligible' and 'comfortable' that are suitable for a particular person in a particular situation) are assumed to be known, or can perhaps be learned as well. The user 'walks over the path between the end points' by using volume wheel or slider in order to set his preferred trade-off in a certain environmental condition. This is schematically illustrated in FIG. 10. The Learning Comfort Control will learn the user-preferred trade-off point (for example depending on then environment) and apply consecutively.

In one exemplary embodiment, the method is utilized to adjust parameters of a tinnitus masker.

Some tinnitus masking (TM) algorithms appear to work sometimes for some people. This uncertainty about its effectiveness, even after the fitting session, makes a TM algorithm suitable for further training though on-line personalization. A patient who suffers from tinnitus is instructed during the fitting session that the hearing aides user control (volume wheel, push button or remote control unit) is actually linked to (parameters of) his tinnitus masking algorithm. The patient is encouraged to adjust the user control at any time to more pleasant settings. An on-line learning algorithm, e.g. the algorithms that are proposed for LVC, could then absorb consistent user adjustment patterns in an automated 'TM control algorithm', e.g. could learn to turn on the TM algorithm in quiet and turn off the TM algorithm in a noisy environment. Patient preference feedback is hence used to tune the parameters for a personalized tinnitus masking algorithm.

The person skilled in the art will recognize that any parameter setting of the hearing aid may be adjusted utilizing the method according to the present embodiments, such as parameter(s) for a beam width algorithm, parameter(s) for a AGC (gains, compression ratios, time constants) algorithm, settings of a program button, etc.

In some embodiments, the user may indicate dissent using the user-interface, e.g. by actuation of a certain button, a so-called dissent button, e.g. on the hearing aid housing or a remote control.

This is a generic interface for personalizing any set of hearing aid parameters. It can therefore be tied to any of the 'on-line learning' embodiments. It is a very intuitive interface from a user point of view, since the user expresses his discomfort with a certain setting by pushing the dissent button, in effect making the statement: "I don't like this, try something better". However, the user does not say what the user would like to hear instead. Therefore, this is a much more challenging interface from an learning point of view. Compare e.g. the LVC, where the user expresses his consent with a certain setting (after having turned the volume wheel to a new desirable position), so the learning algorithm can use this new setting as a 'target setting' or a 'positive example' to train on. Utilizing another algorithm called the Learning Dissent Button LDB, the user only provides 'negative examples' so there is no information about the direction in which the parameters should be changed to achieve a (more) favourable setting.

As an example, the user walks around, and expresses dissent with a certain setting in a certain situation a couple of times. From this 'no go area' in the space of settings, the LDB algorithm estimates a better setting that is applied instead. This could again (e.g. in certain acoustic environments) be 'voted against' by the user by pushing the dissent button, leading to a further refinement of the 'area of acceptable settings'. Many other ways to learn from a dissent button could also be invented, e.g. by toggling through a predefined set of supposedly useful but different settings.

The invention claimed is:

1. A hearing aid, comprising:

a microphone;

a speaker; and a processing unit coupled to the microphone and the speaker, wherein the processing unit is configured to obtain a signal, obtain a measure that corresponds with an adjustment made by a user of the hearing aid, and determine a signal processing parameter based on a feature of the signal, the measure that corresponds with the adjustment made by the user, and an adaptation parameter, the adaptation parameter being a tuning parameter that controls whether to put more weight on new information or previously obtained information when determining the signal processing parameter;

wherein the processing unit is configured to determine the signal processing parameter using an adaptation algorithm that gradually adjusts the signal processing parameter over time.

2. The hearing aid according to claim 1, wherein the processing unit is also configured to determine a user inconsistency parameter based on the measure.

3. The hearing aid according to claim 2, wherein the processing unit is configured to determine the signal processing parameter also based on the user inconsistency parameter.

4. The hearing aid according to claim 1, wherein the signal processing parameter comprises a parameter that relates to signal analysis or signal processing.

5. The hearing aid according to claim 1, wherein the signal processing parameter comprises a compression ratio, an attack and release time, a filter cut-off frequency, or a noise reduction gain.

6. The hearing aid according to claim 1, wherein the processing unit is configured to determine the signal processing parameter automatically.

7. The hearing aid according to claim 1, wherein the processing unit is configured to automatically use the determined signal processing parameter to perform signal processing in the hearing aid.

8. The hearing aid according to claim 1, wherein the measure comprises a measure of a number of active microphone(s).

9. The hearing aid according to claim 1, wherein the measure comprises a measure of an amount of tradeoff between noise reduction and signal distortion.

10. The hearing aid according to claim 1, wherein the measure comprises a measure of volume.

11. The hearing aid according to claim 1, wherein the signal processing parameter is a part of a set of signal processing parameters utilized by the hearing aid, wherein the set of signal processing parameters are stored in a non-transitory medium.

12. The hearing aid according to claim 1, wherein the signal processing parameter comprises a learning parameter that is adjustable based on input from the user and that is learnable by the processing unit.

13. The hearing aid according to claim 12, wherein a value of the learning parameter is based on a previous value of the learning parameter.

14. The hearing aid according to claim 12, wherein the processing unit is configured to determine the learning parameter using a normalized Least Mean Squares algorithm.

15. The hearing aid according to claim 12, wherein the processing unit is configured to determine the learning parameter using a recursive Least Squares algorithm.

16. The hearing aid according to claim 12, wherein the processing unit is configured to determine the learning parameter using a Kalman filtering algorithm.

17. The hearing aid according to claim 12, wherein the processing unit is configured to determine the learning parameter using a Kalman smoothing algorithm.

18. The hearing aid according to claim 1, further comprising:

classifying the feature of the signal into one of a plurality of predetermined signal classes; and substituting the feature of the signal with a classification signal feature of the one of the plurality of predetermined signal classes.

19. The hearing aid according to claim 1, wherein the processing unit is further configured to switch between an omni-directional mode and a directional mode for the microphone.

20. The hearing aid of claim 1, wherein an increase in a value of the adaptation parameter corresponds with putting more weight on the new information.

21. The hearing aid of claim 1, wherein a decrease in a value of the adaptation parameter corresponds with putting more weight on the previously obtained information.

22. The hearing aid of claim 1, wherein the hearing aid further comprises a non-transitory medium for storing the measure at a time of explicit dissent.

23. The hearing aid of claim 1, wherein the hearing aid further comprises a non-transitory medium for storing the measure at a time of explicit consent.

24. The hearing aid of claim 2, wherein the adaptation parameter and the user inconsistency parameter are for controlling a learning speed of the processing unit.

25. The hearing aid of claim 24, wherein the adaptation parameter and the user inconsistency parameter are for controlling a learning speed of the processing unit in opposite directions.

26. The hearing aid of claim 24, wherein an increase in a value of the adaptation parameter increases the learning speed of the processing unit.

27. The hearing aid of claim 24, wherein an increase in a value of the user inconsistency parameter decreases the learning speed of the processing unit.

* * * * *